US005758470A

United States Patent [19]

Lancaster, III

[11] Patent Number: 5,758,470

[45] Date of Patent: Jun. 2, 1998

[54] METHOD AND APPARATUS FOR PLACING CORNERBOARDS AND WRAPPING A LOAD

[75] Inventor: Patrick R. Lancaster, III, Louisville, Ky.

[73] Assignee: Lantech, Inc., Louisville, Ky.

[21] Appl. No.: 705,862

[22] Filed: Aug. 28, 1996

[51] Int. Cl.[6] ..... B65B 61/00; B65B 11/28

[52] U.S. Cl. ..... 53/399; 53/410; 53/139.7; 53/587; 53/588

[58] Field of Search ..... 53/139.5, 139.6, 53/139.7, 399, 410, 472, 587, 588

[56] References Cited

U.S. PATENT DOCUMENTS

| | | | |
|---|---|---|---|
| 2,260,064 | 10/1941 | Stokes | 93/3 |
| 3,095,678 | 7/1963 | Cliff et al. | 53/124 |
| 3,169,471 | 2/1965 | McLean | 100/4 |
| 3,241,287 | 3/1966 | Chundelak, Jr. | 53/128 |
| 3,329,549 | 7/1967 | Vilutis | 156/272 |
| 3,378,987 | 4/1968 | Lems | 53/124 |
| 3,585,780 | 6/1971 | Elmore | 53/124 |
| 3,660,958 | 5/1972 | Garrison | 53/399 |
| 3,916,597 | 11/1975 | Martelli | 53/14 |
| 3,955,409 | 5/1976 | Discavage et al. | 53/139.6 |
| 4,244,471 | 1/1981 | Plante | 206/586 |
| 4,317,322 | 3/1982 | Lancaster et al. | 53/399 |
| 4,387,548 | 6/1983 | Lancaster et al. | 53/399 |
| 4,418,510 | 12/1983 | Lancaster, III et al. | 53/399 |
| 4,691,497 | 9/1987 | Lancaster | 53/399 |
| 4,700,530 | 10/1987 | Norberg | 53/410 |
| 4,887,719 | 12/1989 | Kapke | 206/597 |
| 4,897,980 | 2/1990 | Geyser et al. | 53/128 |
| 4,905,451 | 3/1990 | Jaconelli et al. | 53/410 |
| 5,131,541 | 7/1992 | Liebel | 206/453 |
| 5,143,775 | 9/1992 | Olsson et al. | 428/178 |
| 5,226,280 | 7/1993 | Scherer et al. | 53/139.7 |
| 5,251,753 | 10/1993 | Pigott et al. | 206/386 |
| 5,271,498 | 12/1993 | Gillespie | 206/326 |
| 5,289,668 | 3/1994 | Meyer | 53/410 |
| 5,423,118 | 6/1995 | Lotti | 29/809 |
| 5,450,965 | 9/1995 | Cox | 206/597 |
| 5,546,730 | 8/1996 | Newell et al. | 53/139.7 X |
| 5,596,863 | 1/1997 | Kasel | 53/139.7 X |

FOREIGN PATENT DOCUMENTS

| | | | |
|---|---|---|---|
| 533520 | 3/1993 | European Pat. Off. | 53/139.5 |
| 5-139419 | 1/1993 | Japan | B65B 53/02 |

OTHER PUBLICATIONS

Lantech, Inc., Pallet Shield Dispenser.

Pallet Shield Dispenser Automatic Corrugated Insertion description.

*Primary Examiner*—Linda Johnson

*Attorney, Agent, or Firm*—Finnegan, Henderson, Farabow, Garrett & Dunner, L.L.P.

[57] ABSTRACT

A load is stretch wrapped with a sheet of stretch wrap packaging material dispensed from a stretch wrap packaging material dispenser. A cornerboard is attached to the sheet of stretch wrap packaging material and transported to the load with the stretch wrap packaging material. Relative rotation is provided between the stretch wrap packaging material dispenser and the load to wrap the stretch wrap packaging material around the load. The cornerboard is placed on the corner of the load with the stretch wrap packaging material and bent from a flat configuration to a bent configuration around a corner of the load with the stretch wrap packaging material.

71 Claims, 8 Drawing Sheets

METHOD AND APPARATUS FOR PLACING CORNERBOARDS AND WRAPPING A LOAD

BACKGROUND OF THE INVENTION

1. Field of the Invention

The present invention relates to a method and apparatus for placing cornerboards and wrapping a load. In particular, the present invention is directed to automatically placing cornerboards on the corners of a stacked load and wrapping stretch wrap packaging material around the load while the cornerboards are held in place.

2. Description of the Related Art

Products are often stacked as a load on a pallet to simplify handling of the products. The pallet load is commonly wrapped with stretch wrap packaging material to maintain the stacked configuration. To protect the load during shipping and storage, particularly when the load is fragile to indentation, top and bottom caps are provided on respective ends of the load, and corner protectors are placed on the corners of the load. Care must be taken so the load is not damaged when positioning the protectors on the load.

The positioning of the corner protectors is conventionally a time-consuming and expensive process. If the process is performed manually, a corner protector must first be positioned and temporarily secured on each corner of the load. The corner protector is temporarily secured using tape, straps, or hand wrap film. After a corner protector has been secured in position on each corner of the load, a top cap may be placed on the load, if desired. The load is then transported to a stretch wrapping machine for stretch wrapping.

Automated procedures also are available for positioning corner protectors and top caps on the corner of a load. These automated procedures generally store a number of preformed corner protectors vertically in a magazine. The vertical magazine dispenses the preformed corner protector to a gripper placement device. In turn, the gripper placement device positions the preformed corner protector on a corner of the load by a series of positioning steps. The preformed corner protectors may slip within the gripper placement device as it is removed from the vertical magazine, thereby creating a vertical misalignment between the corner protector and the corner.

Further, if an overhead stretch wrapper is used to wrap the load, the gripper placement device is used to maintain the corner protector in position until after stretch wrapping has been initiated. In such instances, it has been necessary to provide a separate gripper placement device for each corner of the load. The necessity of having four separate magazines and gripper placement devices is costly, both in available work space and initial investment expenses. Even if a single cornerboard placement device is used, the cost of that device is significant relative to the cost of the other components of the packaging machinery.

As such, there remains a need for an apparatus and method for reliably and efficiently placing cornerboards on the corners of a load, and stretch wrapping the load with the cornerboards in place.

SUMMARY OF THE INVENTION

The advantages and purpose of the invention will be set forth in part in the description that follows, and in part will be obvious from the description, or may be learned by practice of the invention. The advantages and purpose of the invention will be realized and attained by means of the elements and combinations particularly pointed out in the appended claims.

To achieve these advantages and in accordance with the purpose of the invention, as embodied and broadly described herein, the present invention includes a method and apparatus for wrapping a load including dispensing packaging material from a packaging material dispenser; attaching a cornerboard to the packaging material; transporting the cornerboard to the load with packaging material; and providing relative movement between the packaging material dispenser and the load to wrap packaging material around the load.

The method and apparatus also preferably include placing the cornerboard on a corner of the load with the packaging material and bending the cornerboard from a flat configuration to a bent configuration around the corner of the load with the packaging material.

It is to be understood that both the foregoing general description and the following detailed description are exemplary and explanatory only and are not restrictive to the invention, as claimed.

The accompanying drawings, which are incorporated in and constitute a part of the specification, illustrate embodiments of the invention and together with the description, serve to explain the principles of the invention.

A BRIEF DESCRIPTION OF THE DRAWINGS

DESCRIPTION OF THE PREFERRED EMBODIMENTS

Reference will now be made in detail to present preferred embodiments of the invention, examples of which are illustrated in the accompanying drawings. Wherever possible, the same reference numbers will be used throughout the drawings to refer to the same or like parts.

In accordance with the present invention, a method and apparatus are provided for wrapping a load with a packaging material. A stretch wrap packaging material dispenser is provided for dispensing stretch wrap packaging material.

Figure 1:
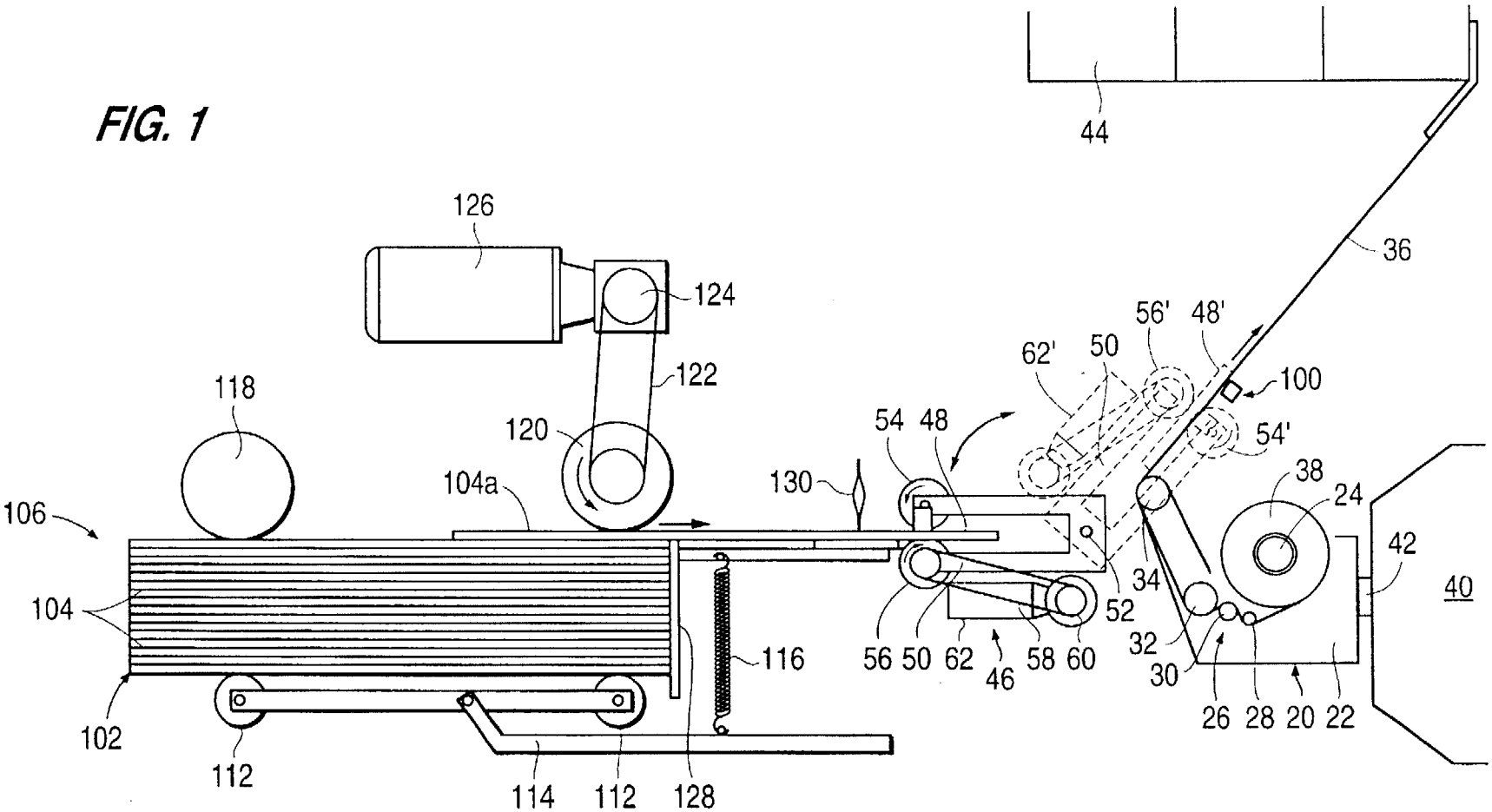
FIG. 1 is a top view of an embodiment of an apparatus incorporating the present invention.
Figure 2:
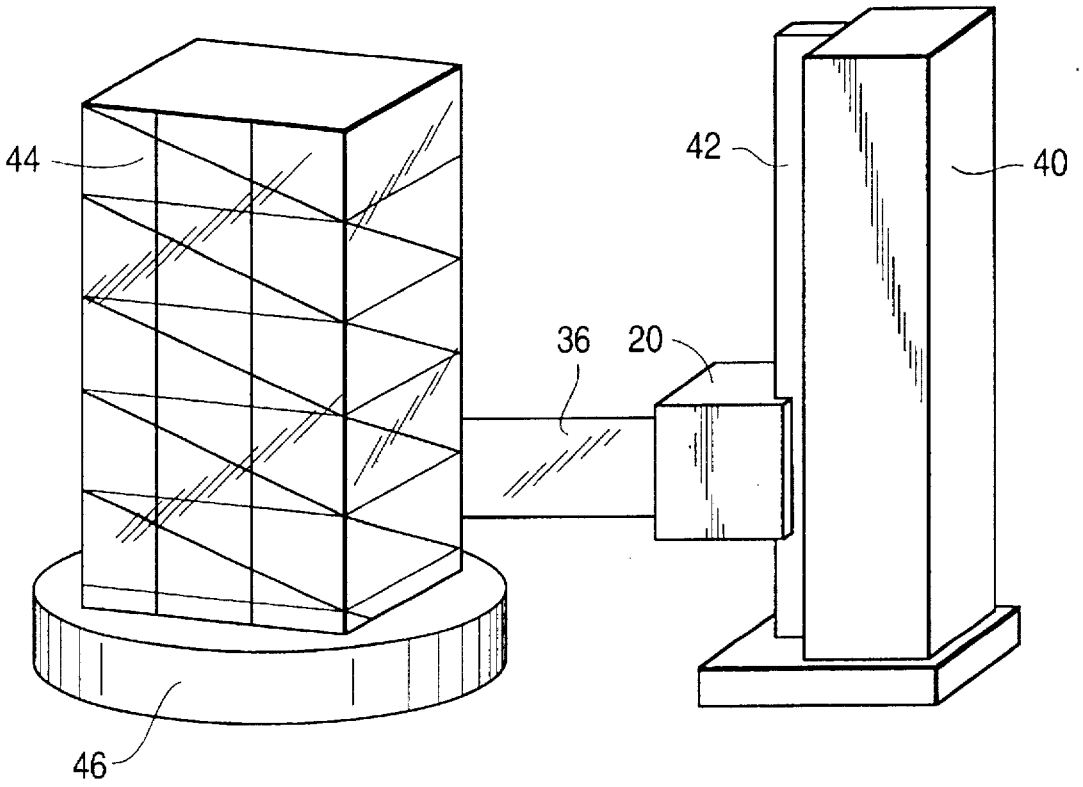
FIG. 2 is a perspective view of the apparatus shown in FIG. 1.

As shown in FIG. 1, the packaging material dispenser includes a dispenser 20 including a frame 22, a film roll support such as post 24, a prestretch device 26, and rollers such as roller 34, which are used to direct the path of stretch wrap packaging material 36 dispensed from roll 38 in dispenser 20. The prestretch device includes an upstream roller 28, an idler roller 30 and a downstream roller 32 which are driven to cause the surface speed of downstream roller 32 to be greater than the speed of upstream roller 28 and thereby stretch the film between the two rollers. Dispenser 20 is mounted on upright 40 through track 42, allowing dispenser 20 to move in the vertical direction so that stretch wrap packaging material 36 can be spirally wrapped on load 44 as shown in FIG. 2.

According to the present invention, there are means for providing relative movement such as rotation between the stretch wrap packaging material dispenser and the load to wrap stretch wrap packaging material around the load. As shown in FIG. 2, the means for providing relative rotation includes a motor-driven turntable 46, which rotates load 44 about a vertical axis and relative to stretch wrap packaging material dispenser 20 to wrap stretch wrap packaging material 36 around load 44.

Other means may be used for providing relative rotation, including devices that revolve a film web dispenser around a stationary load or devices that provide relative rotation about a horizontal axis. A variety of means for providing relative rotation, as well as stretch wrap packaging material dispensers with various prestretch devices, are shown in U.S. Pat. No. 5,161,349, which is incorporated herein by reference. In addition, other means may be used to provide relative movement, such as pass-through arrangements.

Figure 8:
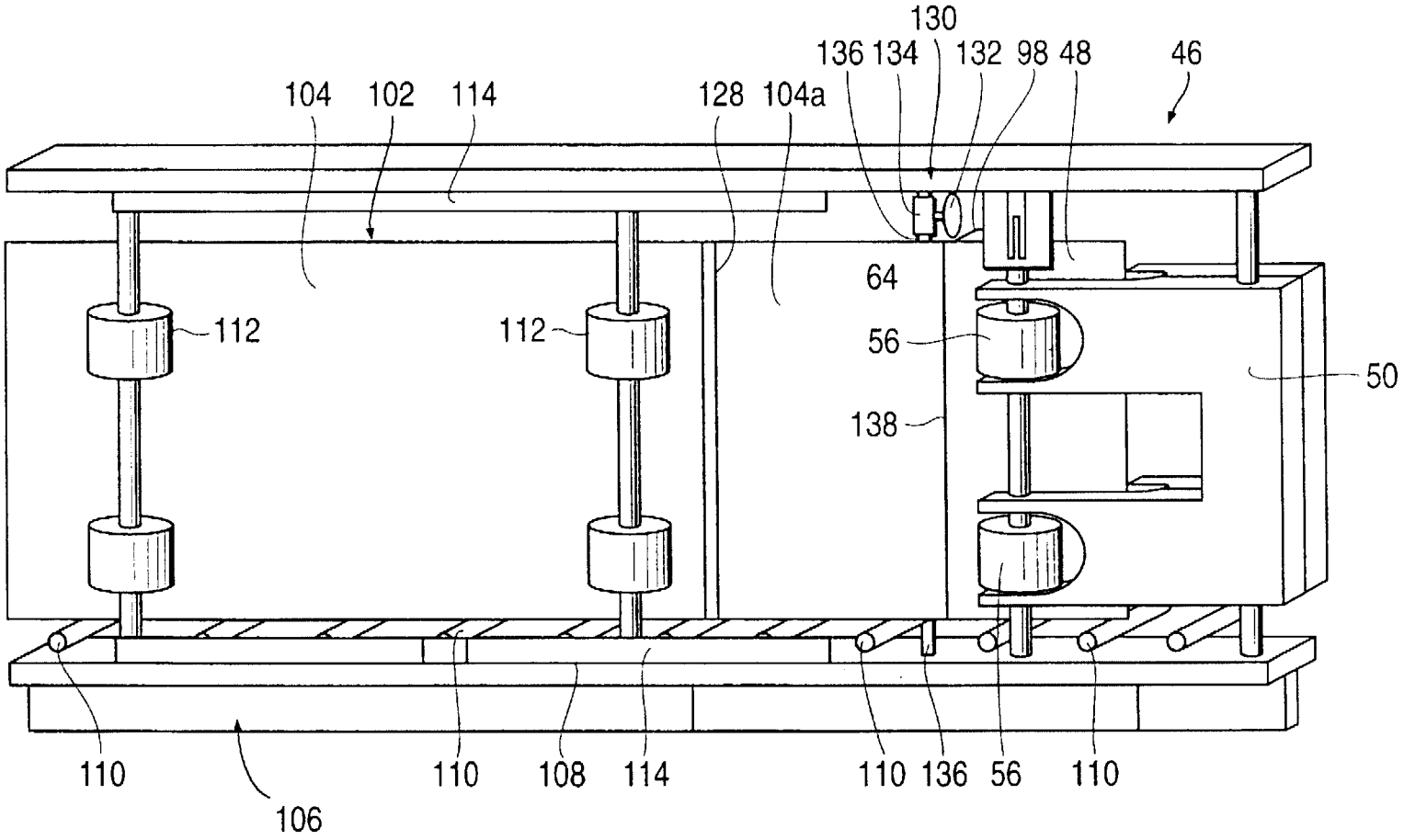
FIG. 8 is a side view of the arrangement shown in FIG. 1.

According to the present invention, means are provided for attaching the cornerboard to the stretch wrap packaging material for permitting the stretch wrap packaging material to transport the cornerboard to the load. As shown in FIGS. 1 and 8, the means for attaching the cornerboard to the stretch wrap packaging material includes a mechanism 46 which associates a cornerboard 48 with the stretch wrap packaging material 36. The associating mechanism 46 shown includes placer arm 50 having a slotted plate 50 rotatably mounted on shaft 52 to pivot between the position shown in solid lines to the position 50' shown in broken lines, transporting cornerboard 48 from a position shown in solid lines to position 48' shown in broken lines. Placer arm 50, supports idler roller 54 and roller 56, are driven by belt 58, pulley 60, and drive motor and reducer 52 thereby allowing a cornerboard 48 to be fed into and out of slotted placer arm 50.

Figure 6:
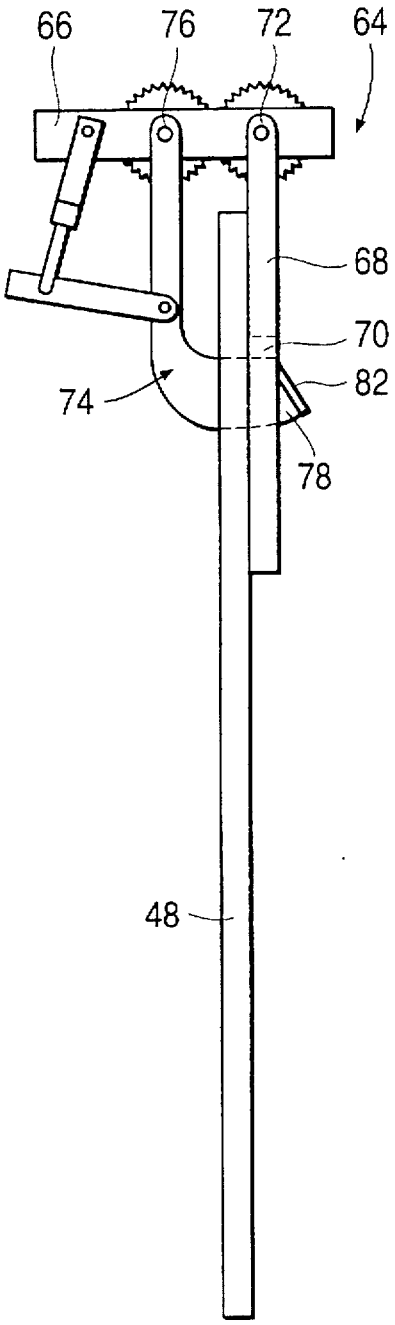
FIG. 6 is an end view of a subassembly of the arrangement shown in FIG. 1.
Figure 7:
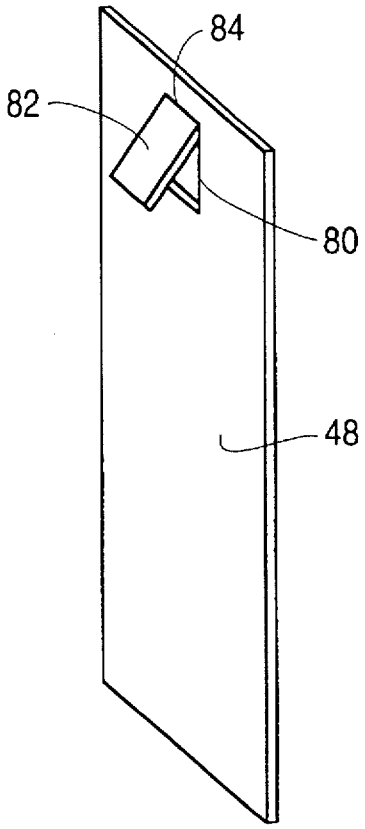
FIG. 7 is a perspective view of a cornerboard according to the present invention.

According to one aspect of the invention, the means for attaching includes means for notching the cornerboard and hanging the cornerboard on the edge of the stretch wrap packaging material. As shown in FIG. 8, a notching mechanism 64 is provided to notch the cornerboard 48. An example of a notching mechanism 64 is shown in more detail in FIG. 6 and includes a frame 66, and a rectangular die plate 68 with a rectangular aperture 70 pivotally mounted on frame 66 about pin 72. A complementary punch 74 is pivotally mounted on frame 66 about pin 76 so that the cutting end 78 of punch 74 cuts through cornerboard 48 to produce, as better shown in FIG. 7, a three sided cut 80 in cornerboard 48 with a resulting tab 82 forming a V-shaped hanging portion with cornerboard 48 along fold line 84.

Figure 4A:
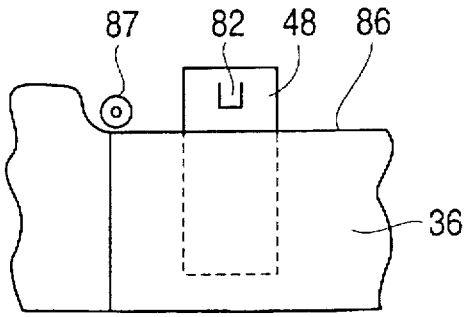
FIGS. 4A and 4B are progressive side views of portions of a wrapping operation incorporating the present invention.
Figure 4B:
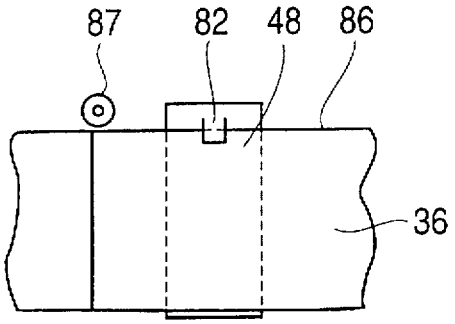

As shown in the sequence of side drawings of FIGS. 4A and 4B, and end drawings of 5A and 5B, cornerboard 48 is hung on the top edge 86 of stretch wrap packaging material 36 by placing the V formed by tab 82 in cornerboard 48 over the top edge 86 of stretch wrap packaging material 36, which may be held taut and preferably in a stretched condition between load 44 and stretch wrap packaging material dispenser 20, due to prestretching or a post-stretched condition.

Figure 5A:
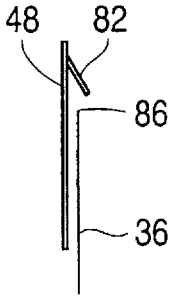
FIGS. 5A and 5B are end views of the portions shown in FIGS. 4A and 4B.
Figure 5B:
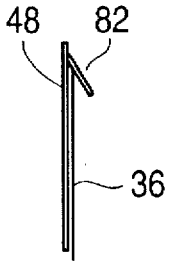

As shown in FIGS. 4A and 5A, roller 87 may be used to form the top edge 86 of stretch wrap packaging material 36 into a roped condition. Roller 87 can move between a lowered position shown in FIG. 4A, to rope the upper edge 86 of the film, and an upper position shown in FIG. 4B, where the upper edge of the film becomes unroped as it proceeds up into the V formed by tab 82 in cornerboard 48. In such an embodiment, the cornerboard 48 may be maintained at a constant elevation and the top edge 86 of stretch wrap packaging material 36 manipulated to engage the V formed by the tab 82 and support the cornerboard. Alternatively cornerboard 48 may be hung on the film 36 by lowering or dropping it on the film.

For example, as shown in FIG. 1, the hanging of cornerboard 48 may be performed by transporting film 36 from the stretch wrap packaging dispenser 20 to the load 44 at the same speed as cornerboard 48' is being transported in a parallel juxtaposed path by rollers 54' and 56' of placer arm 50' shown in the broken line position. The wrap cycle preferably is initiated to the point where the wrapping area includes a full load, the dispenser 20 reaches the top of the load, and the stretch wrap packaging material is in a position to band the top of the load.

Placer arm 50' conveys cornerboard 48 at an elevated position and releases it to fall in the lowered position, thereby hanging cornerboard 48 on stretch wrap packaging material 36. Stretch wrap packaging material 36 then continues to transport cornerboard 48 to the load solely by itself without any additional support and without any additional mechanical devices or assistance to provide the transport function. Other devices may be used for other functions, such as to dampen the swing of cornerboard when placed on the film.

While the cornerboard is shown attached to stretch wrap packaging material, other packaging materials may be used alternatively or in combination, such as netting, roping, banding and strapping and the cornerboard may be attached to one or more of these alternatives.

Figure 3A:
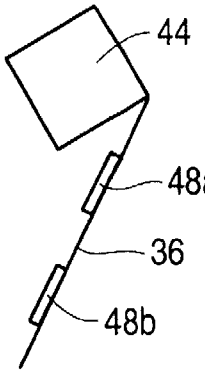
FIGS. 3A through 3F are progressive top views of portions of a wrapping operation incorporating the present invention.
Figure 3B:
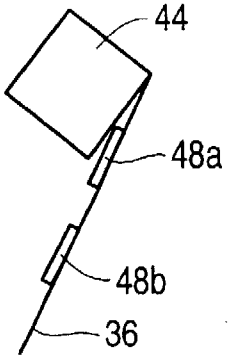
Figure 3C:
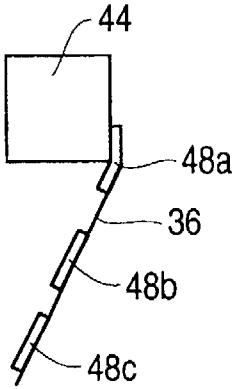
Figure 3D:
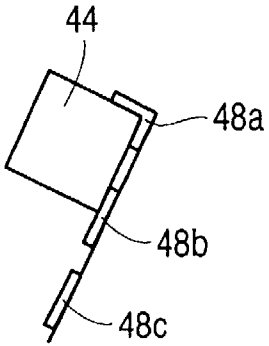

As shown in the sequence of FIGS. 3A through 3F, the stretch wrap packaging material 36 transports a first cornerboard **48*a* to the load 44, places the cornerboard 48*a* on the corner of load 44 without any other mechanical devices or assistance as shown in FIG. 3B, and bends the cornerboard from a flat configuration shown in FIG. 3B through the configuration shown in FIG. 3C, to a bent L-shaped configuration shown in FIG. 3D by bending the cornerboard 48*a* around the corner of load 44 without any other mechanical devices or assistance as load 44 rotates and wraps stretch wrap packaging material 36** around itself. In some applications, the cornerboard may be pre-scored, weakened, steamed, or otherwise treated to allow the cornerboard to be bent in a desirable fashion.

Figure 3E:
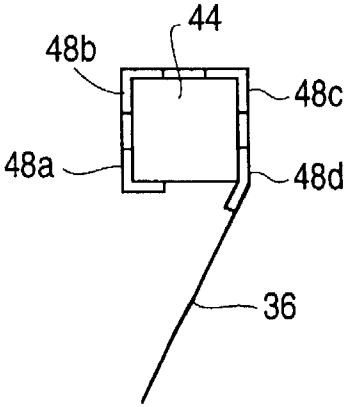
Figure 3F:
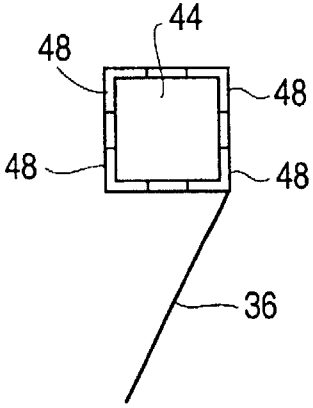

Thus, stretch wrap packaging material 36 transports the cornerboard to the load from the dispensing area, places a cornerboard on a corner of the load and bends the cornerboard from a flat configuration to a bent configuration without any additional devices or assistance. As shown in FIG. 3D and 3E, these steps are repeated to sequentially transport, place, and bend additional cornerboards **48*b*, 48*c*, and 48*c* on respective corners of load 44 in a spaced arrangement, after which wrapping of the protected load can continue to occur in a conventional fashion as shown in FIG. 2 and 3F**. In this arrangement, the cornerboards are transported one at a time. Various controls and sensors may be used to accurately control this operation, for example, controls and sensors conventionally used on stretch wrapping equipment: timers, load cells, photo cells, and microprocessors.

While the notching mechanism 64 preferably provides a single notch in the center of the upper portion of the cornerboard, it is also within the scope of the invention to provide a plurality of notches in the cornerboard. In addition, it is within the scope of the invention to attach the cornerboard to the stretch wrap packaging material by methods other than notching the cornerboard and hanging the cornerboard on the stretch wrap packaging material.

Figure 9:
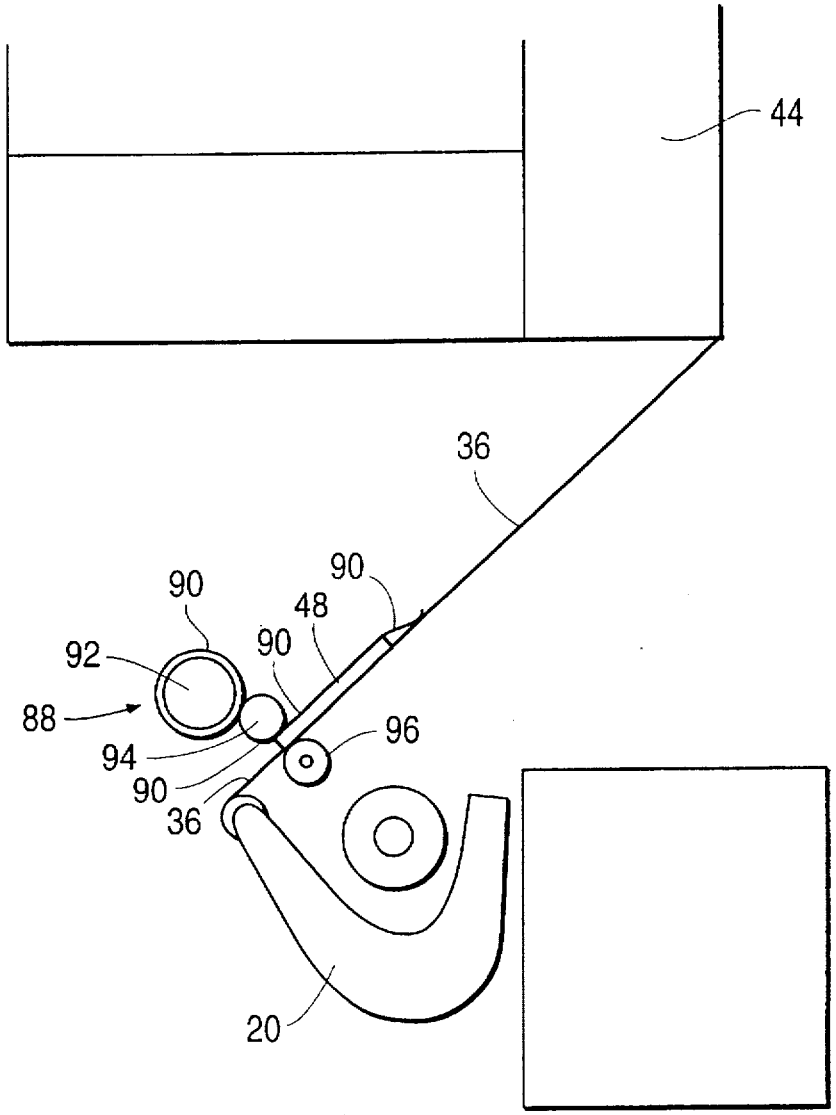
FIG. 9 is a top view of an alternative embodiment according to the present invention.

For example, the means for attaching can include means for adhering the cornerboard to the stretch wrap packaging material by taping or gluing the cornerboard to the stretch wrap packaging material. As shown in FIG. 9, a means for taping includes a tape dispenser 88 that dispenses tape 90 to tape cornerboard 48 to stretch wrap packaging material 36 as the cornerboard 48 and stretch wrap packaging material 36 are dispensed. Tape 90 is dispensed from tape roll 92 around roller 94 and onto stretch wrap packaging material 36 and cornerboard 48. Back pressure roller 96 provides a rolling back stop for the taping operation.

Alternatively, as shown in FIG. 8, a means for gluing may include a glue sprayer 98 which sprays glue along the top edge of the cornerboard, or alternatively, the stretch wrap packaging material, to cause the cornerboard and the stretch wrap packaging material to become attached to each other. The glue can be applied in other ways, such as by a roller or extrusion, or the glue can be applied in other places as well.

The means for attaching can also include other means for associating the stretch wrap packaging material with the cornerboard so that the cornerboard will be transported to the load with the stretch wrap packaging material. For example, as shown in FIG. 1, means for tacking can be provided, such as a tacking mechanism 100 that joins the stretch wrap packaging material 36 to the cornerboard 48 by fasteners such as staples, nails, tacks or similar products.

The means for attaching is not limited to any of these methods or apparatus for associating the stretch wrap packaging material with the cornerboard to allow the cornerboard to be transported to the load by the stretch wrap packaging material. As disclosed and claimed, the cornerboard may be either manually or automatedly associated with the stretch wrap packaging material. In addition, various mechanisms and/or geometric configurations can be used to associate or juxtapose the stretch wrap packaging material and the cornerboards. For example, placer arm 50 or equivalent structure need not be used. Instead, the stretch wrap packaging material and the cornerboards may be associated or juxtaposed so that the cornerboard is transported together by the packaging material by manually placing the cornerboard in contact with the stretch wrap packaging material or automatedly providing a geometry with converging paths for the stretch wrap packaging material and the cornerboards.

According to one aspect of the invention, means are provided for cutting the cornerboard from the sheet. As shown in FIGS. 1 and 8, a stack 102 of sheets 104 of corrugated cardboard or another suitable cornerboard material are placed in the magazine 106. The magazine includes a frame 108 having a series of rollers 110 supporting the stack 102 of cardboard sheets 104 and permitting the sheets 104 to be advanced from left to right. The magazine also includes idler rollers 112 mounted on a retaining assembly 114 that is biased by spring 116 toward the stack to hold the stack in place. Idler 118 retains the stack from the other direction and drive roller 120 is driven through belt 122, pully 124 and motor and reducer 126 to feed the outermost sheet 104*a* from left to right while retaining plate 128 holds the remaining sheets 104 of stack 102 in place, preventing them from advancing.

A cornerboard 48 is separated from the remainder of sheet 104*a* by a cutter 130. As shown in FIG. 8, the cutter includes a rotating blade 132 driven by a motor 134 that is transported in the vertical direction by a vertical loop of chain 136 that is motor driven. As a result, the blade 132 makes a vertical cut 138, separating the cornerboard 48 from the remainder of sheet 104*a*. Other types of cutters may be used as well, including a circular saw blade configuration, a knife edge blade, a pair of blades that are positioned on opposite sides of the cornerboard sheet and which have adjacent sides that touch each other. A manual cutting operation may use a knife to separate the cornerboard from the remainder of the sheet. Furthermore, the cornerboards can be preformed or precut or precreased or prescored and still be within the scope of the invention. The cornerboards may be made of material other than corrugated cardboard and be in a roll, rather than a stack of sheets.

Therefore, according to the presently preferred embodiment, the operation of the apparatus includes feeding a first sheet 104*a* from magazine 106 toward placer arm 50 with drive roller 120 and drawing the first sheet 104*a* into placer arm 50 with drive roller 54. Photocells or other sensors are used to control the feeding operation. When sheet 104*a* is in position, cornerboard 48 is cut to the appropriate width by cutter 130 by actuating its drive and moving it in the vertical direction with chain 136. A notching mechanism 64, which may be located either upstream or downstream of cutter 130, cuts a notch in the top of the cornerboard 48 or the cornerboard sheet 148*a*.

Placer arm 50 rotates about axis 52 to the position shown in broken lines to position the notch 82 just above the top edge 86 of the film. Drive rollers 54' and 56' then reverse direction and convey cornerboard 48' at the same speed and direction as the stretch wrap packaging material 36. Once a cornerboard 48' is fed out of rollers 54' and 56', it falls on to stretch wrap packaging material 36 and is hung on the upper edge 86 of the stretch wrap packaging material. Cornerboard 48 is then carried by the stretch wrap packaging material 36 to a corner of the load 44 and preferably is placed on the load and bent from a flat configuration to a bent configuration by the stretch wrap packaging material.

If a placer arm is used, other elements can be employed to place the cornerboard 48 on the stretch wrap packaging material 36. For instance, rather than using rollers, the placer can hold and release the cornerboard with a vacuum, grippers, or other holding mechanism which can then be switched off or opened to allow the cornerboard to be released. However, a placer arm need not be employed at all. In addition, the cornerboard does not need to be rotated and flipped. For example, the cornerboard can be fed directly onto the stretch wrap packaging material. For example, by dropping it to be hung on the stretch wrap packaging material.

Figure 10:
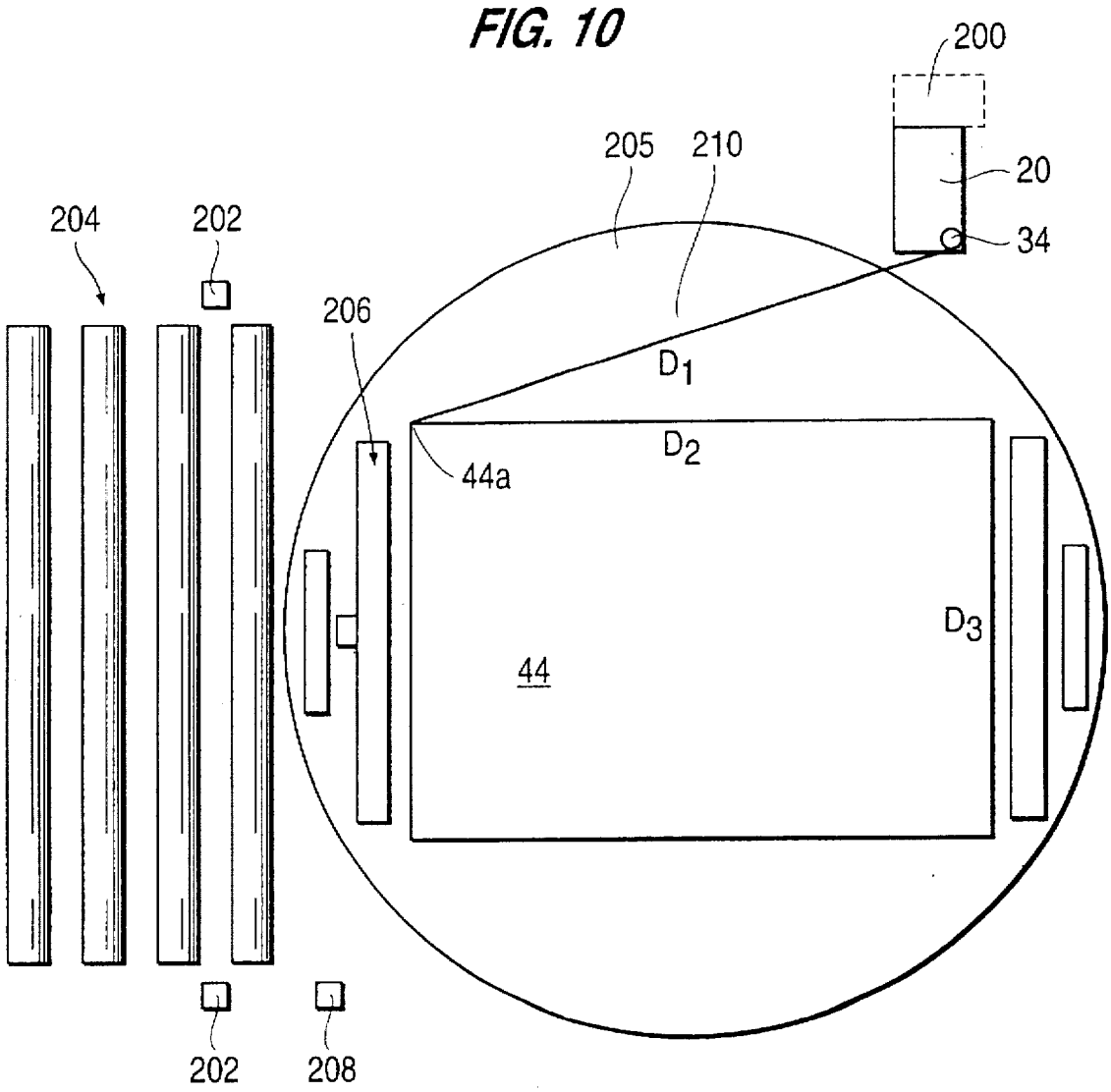
FIG. 10 is a top view of an automated system according to the present invention.

FIG. 10 shows an example of an automated control system 200. The first step performed by the control system 200 is to determine the size of the load 44, namely, its width $D_3$ and length $D_2$. Photocells 202, positioned along the load path, sense the presence of the load 44 and are used to measure the amount of time that the load is blocking them as it proceeds along its path. The speed of infeed roller conveyor 204 is predetermined by the load conveyor drive motor speed and a math function is programmed into the logic to calculate the load length in inches. To measure the load width, a similar procedure can be used. For example, a photocell mounted above the load looking down at a reflector may sense the load as it transfers onto the infeed conveyor or turntable, and the same type of math function is used to calculate its width.

For example, if the conveyor speed is 30 feet per minute, it is converted to six inches per second, preferably by a program having a time base which can be calculated in hundredths of a second. This speed, six inches per second, is multiplied by the amount of time the photocell is blocked to determine the length $D_2$ of the load 44 in inches. The load length $D_2$ is stored in the datafile of the program and used for determining when the cornerboard will be placed on the load.

The second step is to center the load on the turntable 205. During the transition from an infeed conveyor 204 to the turntable conveyor, the load blocks a photocell 208 for a period of time. This time is divided by two and added to the distance from the photocell to the center of the turntable. Timers and counters are used to calculate the values used in centering the load. Once the timer and counter reaches the appropriate value, the load will stop in the center of the turntable 205.

At this point, a distance between the film dispenser 20 and a leading corner 44*a* of the load 44 can be selected from a datafile. A number of values will be preprogrammed in the logic: $D_1$, the distance from the leading corner 44*a* of the load 44 to the last idler roller 34 of the film dispenser 20; $D_2$, the length of the load 44 next to the film clamps 210; and $D_3$, the width of the load 44. At this point, all of the data is known for the load, and the program can do the math to determine when the cornerboards should be placed on the film so they will end up at the corners of the load.

The logic then compares $D_1$ to $D_2$ to let the program know if the first cornerboard can be placed on the next corner. If $D_2$ is greater than $D_1$, the cornerboard will be able to be placed on the next corner, but if $D_1$ is greater than $D_2$, then the load will have to rotate so the second corner can receive the first cornerboard. This second circumstance is probably more common. If the first corner must pass by, then $D_2$ is added to $D_3$ and $D_1$ is subtracted from their sum. This will give the distance the film must travel before it comes in contact with the second corner.

An encoder is used to measure the film in inches and allow the program to know when to place the cornerboard onto the film. The same logic is used to place the other three cornerboards on the film by monitoring the film length in inches and knowing the length of the next side of the load.

The various aspects of the present invention may be used in combination, or independently, without departing from the scope of the invention.

It will be apparent to those skilled in the art that various modifications and variations can be made in the design and fabrication of the apparatus of the present invention, as well as the sequence and performance of the method of the present invention, without departing from the scope or spirit of the invention. Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A method for wrapping a load with packaging material comprising:

dispensing packaging material from a packaging material dispenser; attaching a plurality of cornerboards to the packaging material;

transporting the plurality of cornerboards to the load with the packaging material by using the packaging material to transport the cornerboards;

placing the plurality of cornerboards on corners of the load:

providing relative movement between the packaging material dispenser and the load to wrap the packaging material around the load.

2. The method of claim 1, including placing the cornerboards on the corners of the load with the packaging material.

3. The method of claim 1, including bending the cornerboards from a flat configuration to a bent configuration around the corners of the load with the packaging material.

4. The method of claim 1, wherein the attaching step includes hanging the cornerboards on an edge of the packaging material.

5. A method for wrapping a load with packaging material comprising:

dispensing packaging material from a packaging material dispenser:

attaching a cornerboard to the packaging material:

transporting the cornerboard to the load with the packaging material:

providing relative movement between the packaging material dispenser and the load to wrap the packaging material around the load, wherein the attaching step includes hanging the cornerboard on an edge of the packaging material by roping the edge of the packaging material, bringing the cornerboard and the packaging material together, placing a notch in the cornerboard above the roped edge of the packaging material, and unroping the edge of the packaging material

6. The method of claim 1, wherein the attaching step includes notching the cornerboards and hanging the cornerboards on an edge of the packaging material.

7. The method of claim 6, wherein the notching step includes putting a single notch in each of the plurality of cornerboards.

8. The method of claim 1, wherein the attaching step includes adhering the cornerboards to the packaging material.

9. The method of claim 1, wherein the attaching step includes taping the cornerboards to the packaging material.

10. The method of claim 1, wherein the attaching step includes gluing the cornerboards to the packaging material.

11. The method of claim 1, wherein the attaching step includes tacking the cornerboards to the packaging material.

12. The method of claim 1, including cutting the cornerboards from a sheet.

13. The method of claim 1, including maintaining the cornerboards and packaging material in a generally vertical plane during the transporting step.

14. The method of claim 1, including attaching the plurality of cornerboards to the packaging material in a spaced arrangement.

15. The method of claim 1, including sequentially attaching the plurality of cornerboards to the packaging material in a spaced arrangement and transporting the plurality of cornerboards to the load a single cornerboard at a time.

16. The method of claim 1, including a step of dispensing the cornerboards from a magazine, feeding a cornerboard sheet with rollers, cutting a cornerboard from the cornerboard sheet while holding the cut cornerboard and the cornerboard sheet with the rollers.

17. The method of claim 16, wherein the attaching step includes pivoting the cut cornerboard and rollers.

18. The method of claim 1, wherein the transporting step includes transporting the cornerboards from a cornerboard dispenser to the load solely with the packaging material.

19. The method of claim 2, wherein the transporting step includes transporting the cornerboards from a cornerboard dispenser to the load solely with the packaging material.

20. The method of claim 19, wherein the placing step includes placing the cornerboards on the corners of the load solely with the packaging material.

21. The method of claim 1, wherein the attaching step includes manually attaching the cornerboards to the packaging material.

22. The method of claim 1, wherein the attaching step includes automatically attaching the cornerboards to the packaging material.

23. The method of claim 1 wherein the packaging material is stretch wrap packaging material and the packaging material dispenser is a stretch wrap packaging material dispenser.

24. The method of claim 1 wherein the relative movement is relative rotation between the packaging material dispenser and the load.

25. The method of claim 24, wherein the relative rotation includes rotating the load.

26. An apparatus for wrapping a load with packaging material comprising:

a packaging material dispenser for dispensing packaging material;

means for attaching a plurality of cornerboards to the packaging material so that the packaging material transports the cornerboards to the load;

means for providing relative movement between the packaging material dispenser and the load to wrap the packaging material around the load.

27. The apparatus of claim 26, including a cornerboard dispenser.

28. The apparatus of claim 26, including means for placing the cornerboards on corners of the load with the packaging material.

29. The apparatus of claim 26, including means for placing the cornerboards on corners of the load with the packaging material and bending the cornerboards from a flat configuration to a bent configuration around the corners of the load with the stretch wrap packaging material.

30. An apparatus for wrapping a load with packaging material comprising:

a packaging material dispenser for dispensing packaging material:

means for attaching a cornerboard to the packaging material so that the packaging material transports the cornerboard to the load;

means for providing relative movement between the packaging material dispenser and the load to wrap the packaging material around the load, wherein the means for attaching includes means for hanging the cornerboard on an edge of the packaging material.

31. The apparatus of claim 26, wherein the means for attaching includes means for roping the edge of the packaging material.

32. An apparatus for wrapping a load with packaging material comprising:

a packaging material dispenser for dispensing packaging material, means for attaching a cornerboard to the packaging material so that the packaging material transports the cornerboard to the load;

means for providing relative movement between the packaging material dispenser and the load to wrap the packaging material around the load, wherein the means for attaching includes means for notching the cornerboard and hanging the cornerboard on an edge of the packaging material.

33. The apparatus of claim 32, wherein the notching means provides a single notch in the cornerboard.

34. The apparatus of claim 26, wherein the means for attaching includes means for adhering the cornerboards to the packaging material.

35. The apparatus of claim 26, wherein the means for attaching includes means for taping the cornerboards to the packaging material.

36. The apparatus of claim 26, wherein the means for attaching includes means for gluing the cornerboards to the packaging material.

37. The apparatus of claim 26, wherein the means for attaching includes means for tacking the cornerboards to the packaging material.

38. The apparatus of claim 26, including means for cutting the cornerboards from a sheet.

39. The apparatus of claim 27, wherein the cornerboard dispenser and means for attaching the cornerboards to the packaging material maintain the cornerboards and packaging material in a generally vertical plane when the cornerboards are transported to the load.

40. The apparatus of claim 26, including a controller for controlling the apparatus to place the cornerboards on the corners of the load.

41. The apparatus of claim 27, wherein the cornerboard dispenser includes a series of rollers for feeding a cornerboard sheet and holding the cornerboard sheet while a cornerboard is cut from the cornerboard sheet.

42. The apparatus of claim 26, including a magazine for holding a plurality of cornerboard sheets.

43. The apparatus of claim 26 wherein the packaging material dispenser is a stretch wrap packaging material dispenser.

44. The apparatus of claim 26 wherein the means for providing relative movement includes means for providing relative rotation.

45. The apparatus of claim 44, wherein the means for providing relative rotation includes means for rotating the load.

46. The apparatus of claim 26, wherein the packaging material dispenser includes means for prestretching the packaging material.

47. The apparatus of claim 26 wherein the packaging material dispenser is a stretch wrap packaging material dispenser with means for prestretching stretch wrap packaging materials, the means for providing relative movement includes means for providing relative rotation, the means for attaching includes means for sequentially attaching the plurality of cornerboards to the stretch wrap packaging material.

48. The apparatus of claim 28, including an automated control system for controlling the means for attaching and the means for placing.

49. A method for wrapping a load with packaging material comprising:

dispensing packaging material from a packaging material dispenser;

attaching a cornerboard to the packaging material by hanging the cornerboard on an edge of the packaging material;

transporting the cornerboard to the load with the packaging material by using the packaging material to transport the cornerboard;

providing relative movement between the packaging material dispenser and the load to wrap the packaging material around the load.

50. The method of claim 49, including placing the cornerboard on a corner of the load with the packaging material.

51. The method of claim 49, including bending the cornerboard from a flat configuration to a bent configuration around a corner of the load with the packaging material.

52. The method of claim 49, wherein the attaching step includes roping the edge of the packaging material, bringing the cornerboard and the packaging material together, placing a notch in the cornerboard above the roped edge of the packaging material and unroping the edge of the packaging material to hang the cornerboard on the edge of the packaging material.

53. The method of claim 49, wherein the attaching step includes notching the cornerboard.

54. The method of claim 53, wherein the notching step includes putting a single notch in the cornerboard.

55. The method of claim 49, including hanging a plurality of cornerboards on the edge of the packaging material in a spaced arrangement.

56. The method of claim 50, including hanging a plurality of cornerboards on the edge of the packaging material and placing a cornerboard on each of several corners of the load with the packaging material.

57. The method of claim 49, wherein the transporting step includes transporting the cornerboard from a cornerboard dispenser to the load solely with the packaging material.

58. The method of claim 49, wherein the cornerboard is attached to the packaging material so that the cornerboard extends beyond a width of the packaging material.

59. The method of claim 58, wherein the cornerboard is attached to the packaging material so that an upper portion of the cornerboard extends beyond an upper edge of the packaging material.

60. The method of claim 58, wherein the cornerboard is attached to the packaging material so that a lower portion of the cornerboard extends beyond a lower edge of the packaging material.

61. The method of claim 58, wherein the cornerboard is attached to the packaging material so that an upper portion of the cornerboard extends beyond an upper edge of the packaging material and a lower portion of the cornerboard extends beyond a lower edge of the packaging material.

62. An apparatus for wrapping a load with packaging material comprising:

a packaging material dispenser for dispensing packaging material;

means for hanging the cornerboard on an edge of the packaging material so that the packaging material transports the cornerboard to the load;

means for providing relative movement between the packaging material dispenser and the load to wrap the packaging material around the load.

63. The apparatus of claim 62, including means for placing the cornerboard on a corner of the load with the packaging material.

64. The apparatus of claim 62, including means for placing the cornerboard on a corner of the load with the packaging material and bending the cornerboard from a flat configuration to a bent configuration around a corner of the load with the stretch wrap packaging material.

65. The apparatus of claim 62, wherein the means for hanging includes means for roping the edge of the packaging material.

66. The apparatus of claim 62, wherein the means for hanging includes means for notching the cornerboard.

67. The apparatus of claim 62, wherein the packaging material dispenser is a stretch wrap packaging material dispenser with means for prestretching stretch wrap packaging materials, the means for providing relative movement includes means for providing relative rotation, the means for hanging includes means for sequentially hanging a plurality of cornerboards on the edge of the stretch wrap packaging material.

68. The apparatus of claim 62, wherein the means for attaching includes means for extending the cornerboard beyond a width of the packaging material.

69. The apparatus of claim 68, wherein the means for extending includes means for an upper portion of the cornerboard to extend beyond an upper edge of the packaging material.

70. The apparatus of claim 68, wherein the means for extending includes means for a lower portion of the cornerboard to extend beyond a lower edge of the packaging material.

71. The apparatus of claim 68, wherein the means for extending includes means for an upper portion of the cornerboard to extend beyond an upper edge of the packaging material and for a lower portion of the cornerboard to extend beyond a lower edge of the packaging material.

* * * * *